United States Patent [19]

Frye

[11] Patent Number: 5,039,145

[45] Date of Patent: Aug. 13, 1991

[54] VEHICLE DOOR ACTUATING CONTROL HAVING A FLEXIBLE SEALING MEMBRANE

[75] Inventor: Dale J. Frye, Holland, Mich.

[73] Assignee: Prince Corporation, Holland, Mich.

[21] Appl. No.: 506,285

[22] Filed: Apr. 5, 1990

[51] Int. Cl.[5] ..... E05C 21/02

[52] U.S. Cl. ..... 292/336.3; 292/DIG. 23; 292/143; 292/DIG. 59; 292/200; 292/DIG. 38

[58] Field of Search ..... 292/336.3, DIG. 31, 292/DIG. 70, DIG. 71, DIG. 37, DIG. 38, DIG. 23, DIG. 59, 200, 217, 226, 236, 143, 161, 173, 188; 70/455

[56] References Cited

U.S. PATENT DOCUMENTS

| | | | |
|---|---|---|---|
| 1,808,129 | 12/1927 | Bullis . | |
| 2,001,740 | 5/1935 | McPherson | 292/DIG. 59 |
| 2,075,495 | 1/1935 | Aten . | |
| 3,528,695 | 11/1968 | Peters | 292/336.3 |
| 3,544,148 | 11/1968 | Sandor | 292/336.3 |
| 4,090,379 | 5/1978 | Lehner | 70/455 |
| 4,116,027 | 9/1978 | Tannery | 70/472 |
| 4,193,619 | 3/1980 | Jerila | 292/DIG. 38 |
| 4,412,696 | 11/1983 | Ishii et al. | 292/336.3 |
| 4,497,514 | 2/1985 | Moriya et al. | 292/DIG. 38 |
| 4,511,172 | 4/1985 | Tabata et al. | 292/336.2 |
| 4,674,777 | 6/1987 | Guelck | 292/336.3 |
| 4,707,006 | 11/1987 | Garg et al. | 292/336.3 |
| 4,736,649 | 4/1988 | Beun | 74/526 |
| 4,740,022 | 4/1988 | Takahashi | 292/217 |
| 4,766,697 | 8/1988 | Boileau | 49/352 |
| 4,778,207 | 10/1988 | Gergoe | 292/336.3 |
| 4,818,003 | 4/1989 | Seko et al. | 292/DIG. 31 |
| 4,834,433 | 5/1989 | Keller | 292/DIG. 31 |
| 4,838,590 | 6/1989 | Isomura | 292/DIG. 31 |

FOREIGN PATENT DOCUMENTS

| | | | |
|---|---|---|---|
| 1940453 | 2/1971 | Fed. Rep. of Germany | 292/336.3 |
| 2363060 | 6/1975 | Fed. Rep. of Germany | 292/336.3 |
| 3311992 | 10/1984 | Fed. Rep. of Germany | 292/336.3 |
| 1408313 | 10/1975 | United Kingdom | 292/DIG. 38 |

*Primary Examiner*—Eric K. Nicholson

*Attorney, Agent, or Firm*—Price, Heneveld, Cooper, DeWitt & Litton

[57] ABSTRACT

A movable door actuating member is mechanically connected to a door latching control through a flexible sealing membrane in the door panel. The door actuating member is movably mounted to the door panel and includes a camming surface which deflects the membrane which in turn engages a cam follower of the latching mechanism for actuating the door latch for opening the door.

26 Claims, 3 Drawing Sheets

VEHICLE DOOR ACTUATING CONTROL HAVING A FLEXIBLE SEALING MEMBRANE

BACKGROUND OF THE PRESENT INVENTION

The present invention pertains to a door actuating control and particularly one for use in a vehicle.

Conventional interior door handles for a vehicle are typically mounted to a panel of the door which includes a trim bezel and mounting hardware for a pivoted handle which mechanically interconnects through a mechanical link to a door latch for opening or unlatching the door. Such construction requires somewhat difficult mechanical interconnection of the linkage to the door operating handle during installation of the panel to the door. Further, such construction requires relatively closely controlled tolerances between the door actuating lever and the door panel as well as the door and its latching mechanism so the various parts align properly for assembly and do not stick or bind once assembled.

A relatively large opening is required in the door panel for the door actuating handle which includes a segment which extends through the panel to connect with the linkage. This opening allows leakage of a significant amount of air into the vehicle which is particularly noticeable in northern climates during winter months where very bitter outside temperatures and high vehicle speeds can result in an uncomfortably cold draft next to the arm of a vehicle occupant.

SUMMARY OF THE PRESENT INVENTION

The system of the present invention overcomes these difficulties with prior art construction by providing a door actuating member which is mechanically connected to the door latching mechanism through a flexible sealing membrane in the door panel. The door actuating member is movably mounted to the door panel and includes a camming surface which deflects the membrane which in turn engages a cam follower of the latching mechanism for actuating the door latch for opening the door. Such construction allows considerable tolerance variations between the mounting position of the door actuating member and the door latching mechanism and provides a sealed interface between the inside of the vehicle and the exterior of the vehicle.

Apparatus embodying the present invention includes a door actuating member movably mounted with respect to a door panel and having a flexible membrane positioned between said door actuating member and associated door latching control member. The mechanism is positioned such that when the door panel is mounted to the door, the actuating member cooperates through the flexible member to move the latching member for actuating the door latch for opening the vehicle door. In a preferred embodiment of the invention, the door actuating member comprises a pivoted lever or door handle with a camming surface on a side of a pivot point opposite the handle and engaging the flexible member on an interior side thereof. The door latching mechanism includes a pivoted cam follower member engaging a side of the membrane opposite and in general alignment with the door actuating camming member such that actuation of the door handle moves the latching member sufficiently to unlatch the vehicle door.

These and other objects, advantages and features of the present invention can best be understood by reference to the following description thereof together with reference to the accompanying drawings in which:

DETAILED DESCRIPTION OF THE PREFERRED EMBODIMENT

Figure 1:
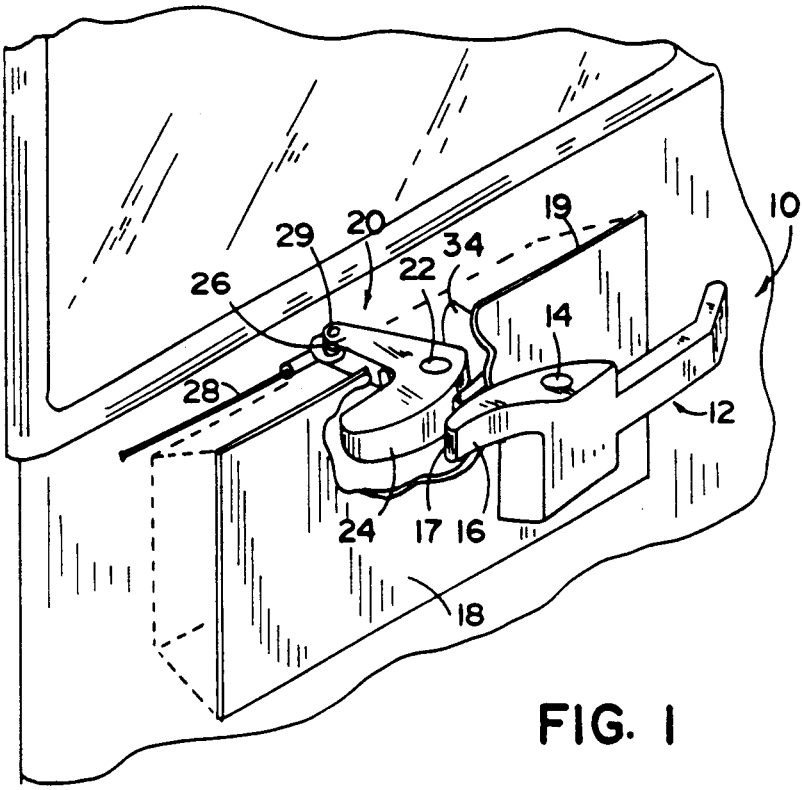
FIG. 1 is a perspective pictorial representation of the system of the present invention.

Referring initially to FIG. 1, there is shown in generally pictorial form, a panel 10 of the door of a vehicle such as an automobile which includes a pivoted door actuating lever or handle 12 which is suitably mounted by means of a pivot pin 14 to the door panel 10. The actuating member 12 includes a camming member 16 on a side of the pivot pin 14 opposite handle 12. The camming member 16 includes a camming surface 17 which engages a flexible membrane 18 which is secured around its peripheral edge 19 to the door panel as described in detail below.

Positioned on the opposite side of membrane 18 and aligned with camming member 16 is a door latch control 20 such as a bell-crank having a pivot connection 22 allowing pivotal motion of the member in response to the flexing of membrane 18 against a cam follower surface 24. Member 20 includes a lever connecting arm 26 to which a door actuating lever 28 is secured at one end by means of a pivot connection 29. The end of lever 28 opposite its connection with member 20 is coupled to a conventional door latch in a conventional manner. The concept of the invention as represented by the pictorial drawing of FIG. 1 therefore is to provide a door actuating member having a movable element such as a cam 16 which engages one side of a flexible membrane 18 which responds to provide a motive force to the door latch control such as bell-crank 20 for actuating the control lever 28 for the latch. Such an arrangement allows the mounting of the door panel 10 to the door to which control 20 is mounted without any mechanical coupling such as pins or other fastening means extending between the door lever assembly and the door latch control. This results since the interconnection is provided by the flexible membrane 18 extending between cam members 16 and 24 by the installation of the door panel 10 to the vehicle door.

Figure 2:
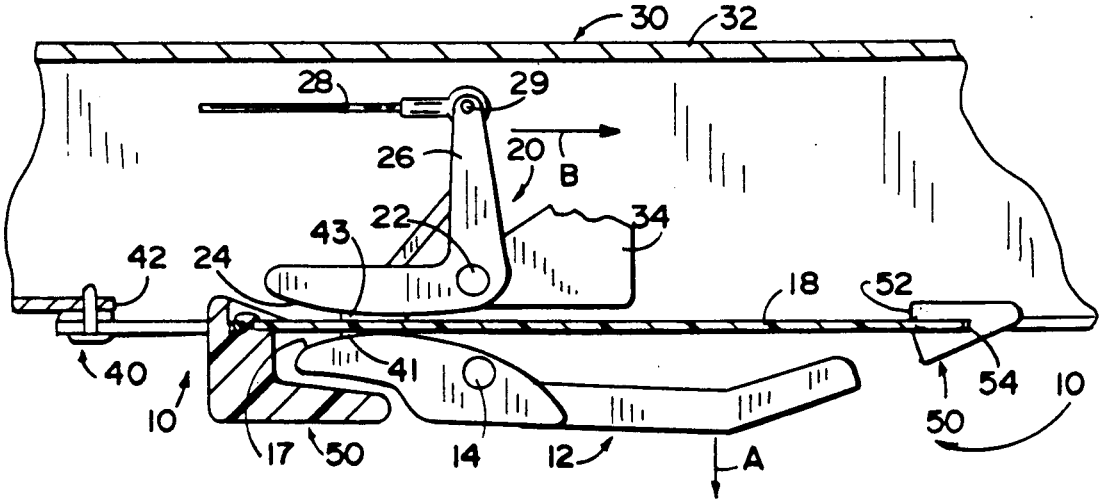
FIG. 2 is a top fragmentary plan view of one embodiment of the present invention.
Figure 3:
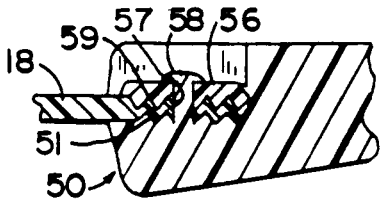
FIG. 3 is an enlarged fragmentary top plan view of an alternate embodiment of a portion of the structure shown in FIG. 2.

FIGS. 2 and 3 illustrate in greater detail one manner in which the flexible member or diaphragm 18 and door actuating mechanism can be mounted to a vehicle door 30. Door 30 includes an exterior typically sheet metal 32 which is finished and defines the exterior of the vehicle door. The door 30 also includes a variety of generally conventional framework, including a mounting bracket 34 to which the bell-crank 20 of FIG. 1 is pivotally mounted by means of a pivot pin 22. A door panel 10 is mounted to the door 30 by means of a plurality of fasteners 40 positioned at various locations around the door panel 10 including areas immediately adjacent the door handle assembly 12. The fasteners 40 extend through the door panel 10 and into a sheet metal frame member 42 of the vehicle door 30. The flexible membrane 18 is secured to a generally rectangular bezel 50 which is mounted within the door panel 10 in a conventional manner such as by screws, snap fasteners or the like as seen in FIG. 2. The flexible membrane 18 is in turn mounted within a generally rectangular opening 52 formed in bezel 50 by means of a peripheral recess 54 formed around the edge of the opening 52 or by a rectangular backing plate such as plate 56 shown in an alternate embodiment of FIG. 3. In the embodiment shown in FIG. 2, the membrane is positioned within the recess 54 which is subsequently crimped shut over the member to securely hold the membrane therein. The polymeric membrane can be bonded to the polymeric bezel by a chemical solvent or adhesive if desired or fused by a heat process.

In the embodiment shown in FIG. 3, the membrane 18 is laid against the toothed surface 51 of bezel 50 and a toothed backing plate 56 is either heat staked as provided by the integral stake 58 which extends through apertures 57 in backing plate 56 or by other suitable fasteners. The facing surface of the backing plate 56 includes teeth 59 to assist in holding the membrane in place.

In the embodiments shown, the membrane is made of a suitable polymeric material such as polyvinyl chloride or the like and can be bonded to the polymeric bezel 50 which can be made of a polycarbonate, an ABS or other suitable material. In one installation, membrane 18 was made of a relatively thick silicone RTVC material having a thickness of 0.060 inches. In a preferred embodiment, however, the material would preferably be made of a sheet of PVC having a thickness of from about 0.005 to 0.060 inches which is not critical as long as the material has sufficient flexibility and yet is sufficiently durable. In order to protect the membrane 18 from wear at the contact interfaces between camming surface 17 of door handle 12 and responsive cam follower surface 24 of the door latch control, wear pads 41 and 43 can be adhesively attached to the membrane 18 at the opposed contact points as illustrated in FIG. 2. In FIG. 2 wear pads 41 and 43 which can be of any suitable material such as polyvinyl chloride (PVC) with self-sticking adhesive on one side are placed on opposite sides of the membrane 18.

The handle 12 shown in FIG. 2 includes a pivot pin 14 which is mounted between horizontally extending upper and lower vertical walls (not shown) of the bezel, the handle is spring loaded to remain in its stored position as illustrated in FIG. 2 and can be pivoted about pin 14 such that surface 17 deflects membrane 18 as the handle is pulled outwardly in a direction indicated by arrow A in FIG. 2. The deflected membrane in turn presses against surface 24 of door latch control 20, causing it to pivot in the direction indicated by arrow B, pulling on lever 28 which is coupled to the conventional mechanical door latch of the vehicle for unlatching the door. Membrane 18 will typically deflect approximately ¼ of an inch. This motion translates to the cam follower surface 24 and the pivot arm 26 associated with the door latch control 20, a sufficient distance to move arm 28 enough for unlatching the vehicle door. Naturally, the amount of motion necessary to unlatch the door by virture of movement of the control rod member 28 varies from car to car. The length of arm 26 can accordingly be varied to provide the sufficient amount of motion in response to the pivotal motion of member 20 of pivot pin 22 to provide the necessary movement. An alternate embodiment of the invention is shown in FIGS. 4–7 which shows a recessed door handle and door latch control mounting mechanism in greater detail.

Figure 4:
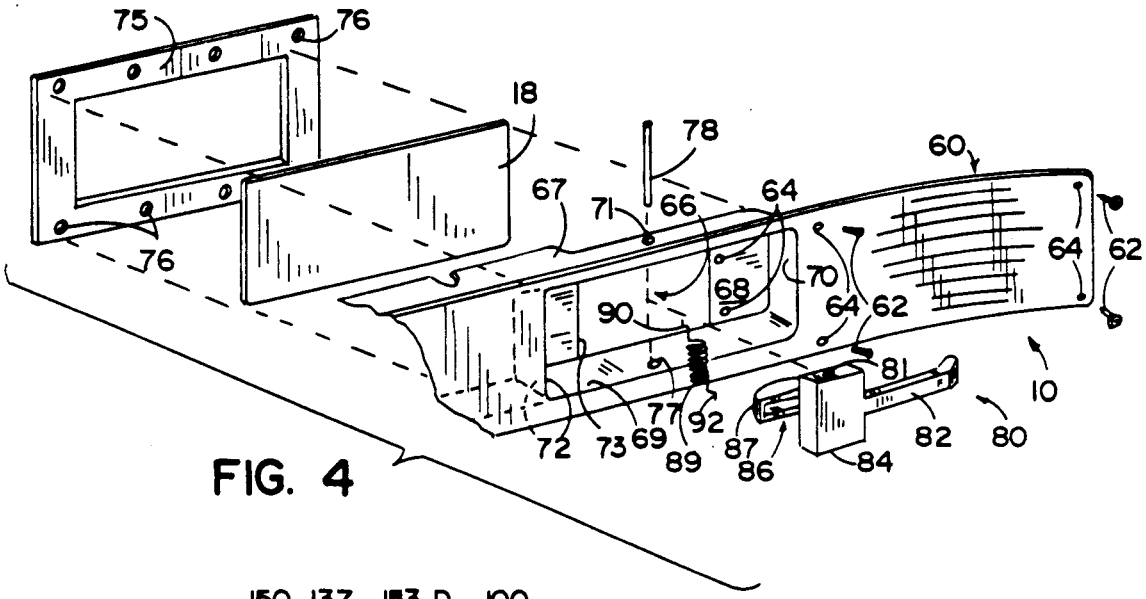
FIG. 4 is an exploded fragmentary perspective view of an alternate embodiment of a portion of the present invention showing the door actuating member thereof.

Referring now to FIG. 4 there is shown a bezel 60 which is secured to a door panel 10 of a vehicle by means of a plurality of fastening screws 62 which extend through apertures 64 positioned at various locations on the bezel to secure the bezel to the vehicle door panel 10 and the door panel 10 to the sheet metal door support structure underlying the door panel. Thus in some instances, a screw 62 will extend both through the bezel into the door panel and also into the underlying sheet metal structure of the door itself. The forward portion of bezel 60 includes a speaker grille 65 behind which there is mounted a speaker for the vehicle's audio system. The bezel 60 shown is that of the driver's side door and includes an integrally formed recess 66 for receiving the movable door actuating member 80. The recess 66 is defined by an integral upper wall 67, rear wall 68, bottom wall 69 and side walls 70 and 72. The rear wall 68 includes a relatively large rectangular opening 73 which is covered by a flexible membrane 18 of the type disclosed in connection with FIGS. 1–3. Membrane 18 can be attached to the rear wall 68 of the bezel around the periphery of aperture 73 by the fastening structure illustrated in FIG. 3. For such purpose a rectangular mounting ring 75 having a plurality of spaced apertures 76 is employed and can either fit over integrally formed heat stake posts such as post 58 of FIG. 3 which extend rearwardly from wall 68 of bezel 60 around opening 73 in a manner shown in FIG. 3. Alternately screw fasteners can be employed to attach ring 75 to the back of the polymeric bezel 60 for securely holding the edge of the membrane to the bezel. The particular polymeric material selected for bezel 60 can be any suitable material such as an ABS or polycarbonate. The upper and lower walls 67 and 69 of bezel recess 66 include apertures 71 and 77 respectively for receiving a pivot pin 78 which pivotally mounts the movable door actuating member 80 within the recess 66.

Door actuating member 80 comprises as best seen in the FIG., a handle portion 82, a hollowed housing portion 84 through which there extends an aperture 81 for receiving pivot pin 78; and a cam member 86 having a curved camming surface 87. Cam member 86 extends on a side of the pivot pin 78 opposite from handle 82. A coil spring 89 is mounted around pivot pin 78 and within the central body 84 of the assembly 80 and has an upper end 90 which engages the upper wall 67 of bezel 60 while the lower end 92 of the spring engages the body portion 84 of the handle to spring bias the handle in a normally retracted position flush within recess 66. Positioned on the side of membrane 18 opposite control member 80 and in alignment therewith as illustrated in FIG. 6, is a door latch control assembly shown in FIG. 5 and now described.

The door latch control in the system of the present invention comprises a pivoted cam follower member 100 which is pivotally mounted to a mounting bracket 130 by means of a pivot pin 132′ extending through apertures 131 and 133 in upper and lower flanges 132 and 134 respectively of bracket 130. Bracket 130 includes an integral rear wall 135 with mounting flanges at opposite ends for receiving fastening screws 136 which secure the bracket to a sheet metal portion 34 (FIG. 6) of the vehicle. Bracket 130 also includes a rearwardly bent flange 137 with a collar 138 for receiving an actuating cable 150 for controlling the vehicle door latch 200 associated with the given vehicle. Cable 150 has a collar 152 which fits within collar 138 and which terminates the outer sheath 151 of the cable. An inner control cable 153 extends through an aperture in flange 137 and is secured to member 100 through an aperture 102 formed on the elongated pivot leg 104 thereof and is secured in position by a locking collar 154 which extends on the rear surface of arm 104 such that as arm pivots in a direction indicated by arrow C in FIG. 5, it pulls against the collar 154 which has a set screw locking the collar to cable 153 for pulling the inner cable 153 in a direction indicated by arrow D. The opposite end of cable 153 is coupled to a standard door latch 200 through an adapter bracket 210 which is mounted to the sheet metal of the vehicle door adjacent latch assembly 200 such that the end 156 of the cable can be attached to an operating portion of the latch 200 for unlatching the vehicle door latch when the cable is moved in a direction indicated by arrow D by the follower assembly 100.

The follower 100 includes a first arm 104 which is defined by a vertical wall and horizontal edges and which extends through an aperture 138 of bracket 130. Follower 100 also includes a second somewhat shorter and generally orthogonally extending arm 106 which is defined by a pair of flanges each including an aperture 107 formed therein for receiving a pivot pin 108 for mounting a roller follower 109 to the end of arms 106. Spacer discs 110 are positioned on the outside of arms 106 at the top and bottom thereof by pin 108 for mounting the smaller follower mechanism 100 between the flanges 132 and 134 of bracket 135 as best seen in FIG. 7. Roller 109 is free to rotate about pivot access 108 and engages the membrane as shown in FIG. 6 on a side opposite cam surface 87.

Figure 6:
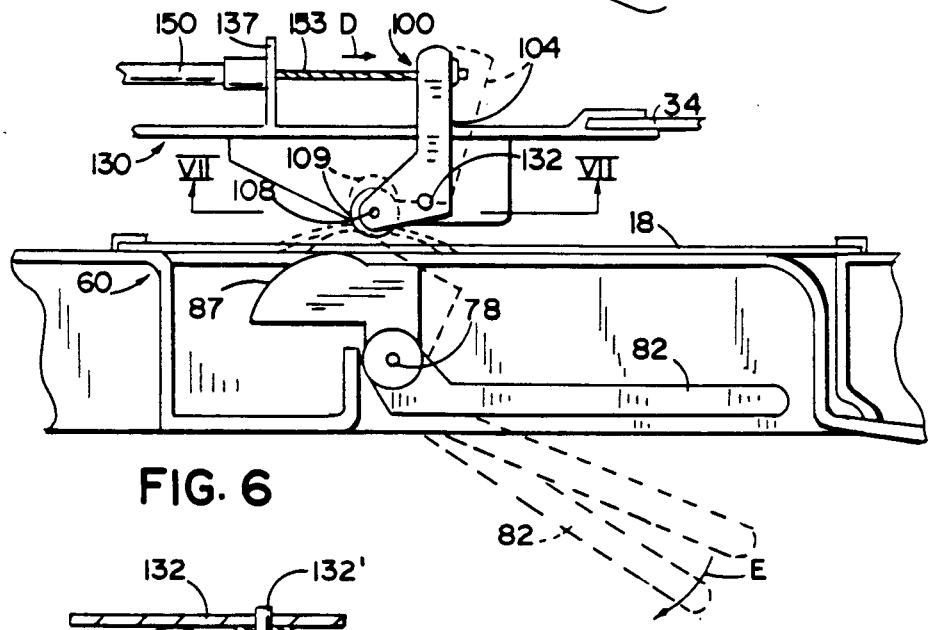
FIG. 6 is an enlarged fragmentary top plan view of the assembly of the structure shown in FIGS. 4 and 5.
Figure 7:
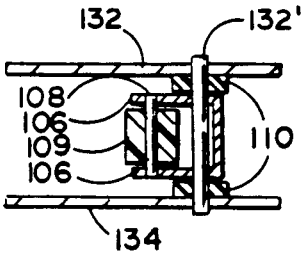
FIG. 7 is a cross-sectional view taken along section lines VII—VII of FIG. 6.
Figure 5:
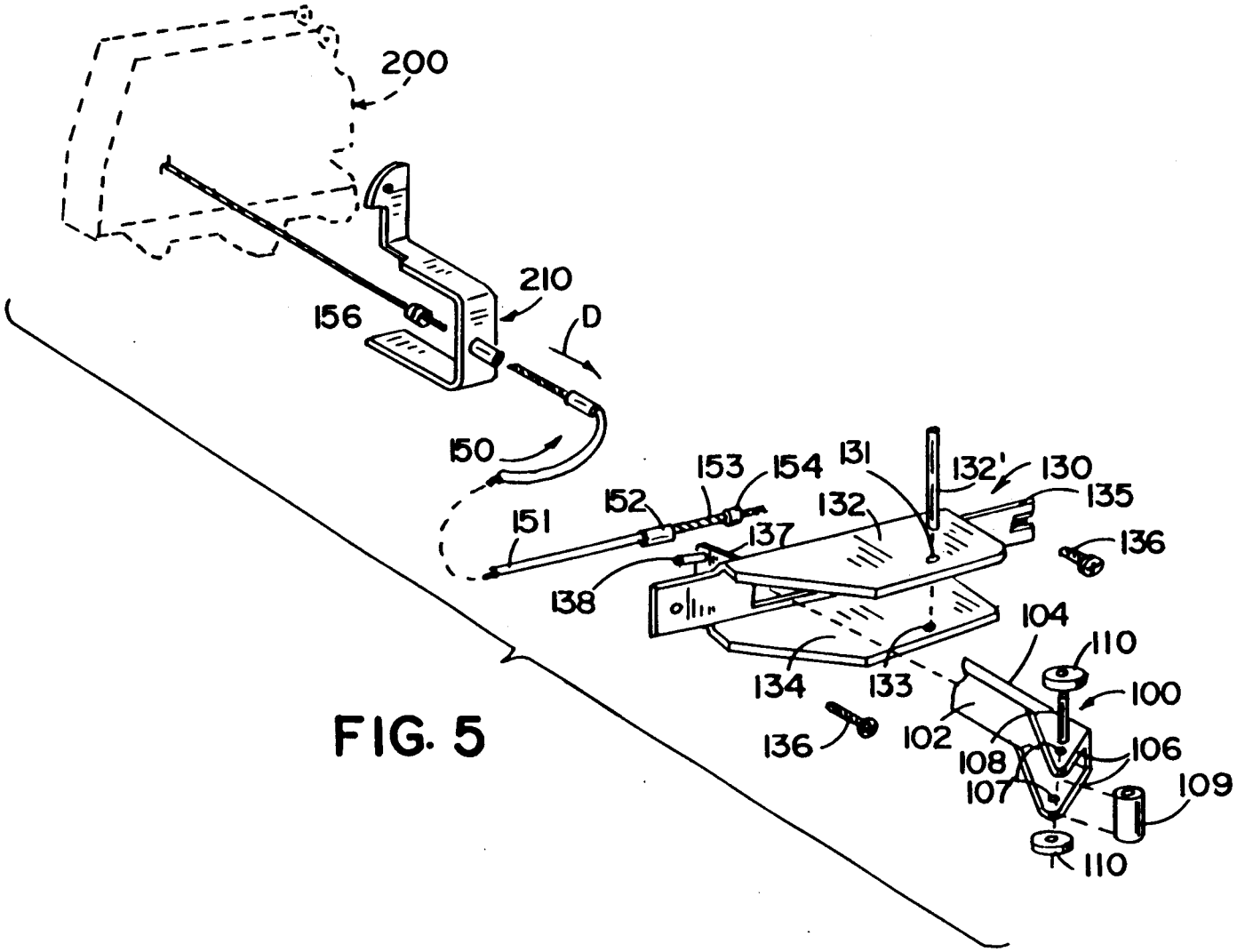
FIG. 5 is an exploded fragmentary perspective view of the door latch control mechanism which cooperates with the structure shown in FIG. 4.

The operation of the system is best seen in FIG. 6 in which the handle 82 is shown in solid lines in its normally retracted position and in phantom lines in its operated position as is the follower assembly 100. As the handle is pulled outwardly to open the door as indicated by arrow E in the FIG., the handle rotates about pivot pin 78 in a clockwise direction as shown in FIG. 6 such that the curved cam surface 87 engages membrane 18 deflecting it against the roller 109 of the follower assembly 100. The follower assembly pivots about its pivot point 132' with its lever arm 104 drawing cable 153 inwardly in a direction indicated by arrow D in the FIG. The deflection of the membrane therefore causes the unlatching of the vehicle door. Naturally, by the utilization of the membrane 18 which can be bonded or otherwise attached to the rear of bezel 60, any air which has leaked into the door panel will be blocked from entering the interior compartment of the vehicle. Also by providing a relatively elongated (in a vertical direction) cam surface 87 as well as a roller follower 109 having a significant height, in conjunction with the membrane 18, the mounting tolerances between the door panel 10 to which bezel 60 is mounted as well as the door actuating assembly 80 and the door 30 are not as critical. Naturally the door actuating mechanism 80 can be of any type which will provide deflection of the membrane 18 in an amount sufficient to cause actuation of the door latch. Thus a push-button or other type of control can be employed in connection with the present invention.

These and other modifications to the preferred embodiments of the present invention as described herein can be made by those skilled in the art without departing from the spirit or scope thereof as defined by the appended claims.

The embodiments of the invention in which an exclusive property or privilege is claimed are defined as follows:

1. A door actuating control for a vehicle comprising:
- a vehicle door including a latch;
- a movable door actuating member mounted to said door;
- a door latch control mounted to said door and to said latch and including a portion in alignment with said door actuating member; and
- a flexible membrane mounted to said door between said door actuating member and said portion of said door latch control and deflected by actuation of said door actuating member to actuate said door latch control and provide a sealed interface between the inside of the vehicle and the exterior of the vehicle.

2. The apparatus as defined in claim 1 and further including a door panel mounted to said door and wherein said movable door actuating member is mounted to said panel.

3. The apparatus as defined in claim 2 wherein said door actuating member includes a handle pivotally mounted to said door panel.

4. The apparatus as defined in claim 3 wherein said door actuating member further includes a cam surface on a side of the pivot connection of said member to said door panel opposite said handle.

5. The apparatus as defined in claim 4 wherein said door latch control includes a cam follower engaged by said membrane in response to deflection by said cam surface.

6. The apparatus as defined in claim 5 wherein said membrane is made of a sheet of polymeric material.

7. The apparatus as defined in claim 6 wherein said door latch control is pivotally mounted to said vehicle door.

8. The apparatus as defined in claim 7 wherein said cam follower includes a roller.

9. The apparatus as defined in claim 8 wherein said door latch control includes a pair of arms extending in generally orthogonal relationship and wherein said roller is mounted to an end of one of said arms.

10. The apparatus as defined in claim 9 wherein the remaining arm of said door latch control is coupled to said latch.

11. The apparatus as defined in claim 10 wherein said membrane is made of PVC having a thickness of from about 0.005 to 0.060 inches.

12. A door actuating control for a vehicle comprising:
- a vehicle interior door panel;
- a movable door actuating member and means for mounting said member panel;
- a door latch control mounted to a vehicle door and adapted to be coupled to a latch associated with the door and including a portion in alignment with said door actuating member; and a flexible membrane mounted to said panel between said door actuating member and said portion of said door latch control and deflected by actuation of said door actuating member to actuate said door latch control and provide a sealed interface between the inside of the vehicle and the exterior of the vehicle.

13. The apparatus as defined in claim 12 wherein said means for mounting said member to said panel comprises a bezel.

14. The apparatus as defined in claim 13 wherein said membrane is made of a sheet of polymeric material.

15. The apparatus as defined in 14 wherein said membrane is made of PVC having a thickness of from about 0.005 to 0.060 inches.

16. The apparatus as defined in claim 12 wherein said door actuating member includes a handle pivotally mounted to said door panel.

17. The apparatus as defined in claim 16 wherein said door actuating member further includes a cam surface on a side of the pivot connection of said member to said door panel opposite said handle.

18. The apparatus as defined in claim 17 wherein said door latch control includes a cam follower engaged by said membrane in response to deflection by said cam surface.

19. The apparatus as defined in claim 18 wherein said door latch control is pivotally mounted to the vehicle door.

20. The apparatus as defined in claim 19 wherein said cam follower includes a roller.

21. The apparatus as defined in claim 20 wherein said door latch control includes a pair of arms extending in generally orthogonal relationship and wherein said roller is mounted to an end of one of said arms.

22. The apparatus as defined in claim 21 wherein said door latch control is pivotally mounted at the junction of said arms.

23. A door actuating control for a vehicle comprising:

a vehicle door including a latch;

an interior door panel mounted to said door;

a door actuating member mounted to said panel and including a cam surface;

a door latch control mounted to said door and coupled to said latch and including a cam follower positioned in general alignment with said cam surface of said door actuating member; and a flexible membrane mounted to said door panel between said cam surface member and said cam follower and deflected by actuation of said door actuating member to actuate said door latch control and provide a sealed interface between the inside of the vehicle and the exterior of the vehicle.

24. The apparatus as defined in claim 23 wherein said membrane is made of a sheet of polymeric material.

25. The apparatus as defined in claim 24 wherein said cam follower includes a roller.

26. The apparatus as defined in claim 25 wherein said membrane is made of PVC having a thickness of from about 0.005 to 0.060 inches.

* * * * *